US005925600A

United States Patent [19]

Atherton

[11] Patent Number: 5,925,600

[45] Date of Patent: Jul. 20, 1999

[54] LUBRICANT COMPOSITION CONTAINING COMBINATION OF ANTIWEAR AND ANTIOXIDANT ADDITIVES

[75] Inventor: John Ian Atherton, Cassington, United Kingdom

[73] Assignee: Exxon Research and Engineering Co., Florham Park, N.J.

[21] Appl. No.: 08/612,850

[22] PCT Filed: Sep. 9, 1994

[86] PCT No.: PCT/GB94/01974

§ 371 Date: Jul. 29, 1996

§ 102(e) Date: Jul. 29, 1996

[87] PCT Pub. No.: WO95/07966

PCT Pub. Date: Mar. 23, 1995

[30] Foreign Application Priority Data

Sep. 13, 1993 [GB] United Kingdom ..... 9318928

[51] Int. Cl.[6] ..... C10M 135/18

[52] U.S. Cl. ..... 508/364; 508/371

[58] Field of Search ..... 508/364, 371, 508/377, 433, 438

[56] References Cited

U.S. PATENT DOCUMENTS

| | | | |
|---|---|---|---|
| 2,739,122 | 3/1956 | Kennerly | 508/378 |
| 4,116,874 | 9/1978 | Sugiura et al. | 508/438 |
| 4,369,119 | 1/1983 | deVries | 508/122 |
| 4,370,246 | 1/1983 | deVries | 508/162 |
| 4,529,526 | 7/1985 | Inoue et al. | 508/162 |
| 4,692,256 | 9/1987 | Umemura et al. | 508/162 |
| 4,832,867 | 5/1989 | Seiki et al. | 508/122 |

FOREIGN PATENT DOCUMENTS 6080981 3/1994 Japan .

OTHER PUBLICATIONS

Mortier, RM. Chemistry and Technology of Lubricants, pp. 94–99, 108–109. Blackie, Glasgow & London, 1992.

*Primary Examiner*—Jacqueline V. Howard
*Assistant Examiner*—Cephia D. Toomer

[57] ABSTRACT

A lubricant composition e.g. for engine oils comprises (i) a base oil, (ii) an antiwear additive combination comprising (a) an organo-molybdenum compound and (b) an asoless organo-phospoorus compound, and (iii) an antioxidant additive combination comprising (d) an aminic antioxidant and (e) a phenolic antioxidant, the weight ratio of aminic antioxidant to phenolic antioxidant being greater than 1:1, preferably from 1.5:1 to 20:1. The antiwear additive combination (ii) may further comprise (c) a zinc thiophosphate compound selected from zinc dialkyldithiophosphate, zinc diaryldithiophosphate and zinc alkylaryldithiophosphate and zinc arylalkyldithiopoosphate and mixtures thereof.

10 Claims, No Drawings

LUBRICANT COMPOSITION CONTAINING COMBINATION OF ANTIWEAR AND ANTIOXIDANT ADDITIVES

This application is a 371 of PCT/GB94/01974 filed Sep. 9, 1994.

This invention relates to a lubricant composition combining a combination of additives providing antiwear properties and a combination of additives providing antioxidant properties.

It is well known to include antiwear additives and antioxidants in lubricating oils such as engine oils. Antiwear additives are included to reduce the wear occurring when two metal surfaces rub together, i.e. boundary lubrication regimes, such as is found in valve trains in internal combustion engines. As well as reducing the operational lifetime of the metal parts, wear has the disadvantage that it releases metal contaminants into the lubricating oil which tend to accelerate the formation of engine oil sludge. It is believed that the antiwear additive acts to provide a protective film over the metal surfaces. Antioxidants are included to protect against sludge formation. Sludge is formed in engines as the result of a complex degradation of the lubricating oil in service. A number of interacting factors are believed to cause degradation including the engine design—particularly the recirculation of crankcase blow-by gases, fuel quality, oil consumption and vehicle operation, especially stop-go "city" driving. The net effect of these factors is a concentration of harmful contaminants in the lubricating oil leading to oxidative degradation of the oil which results in a thickened sludgy oil with reduced lubrication qualities. This thickened oil can also deposit in the engine with harmful effects.

It is recognised that dispersant additives are effective at reducing sludge deposition by solubilising the contaminants in the oil. However, dispersants have the disadvantage that they merely minimise sludge drop-out rather than prevent the initial degradation of the oil. Although dispersive action is important, the combined prevention of engine wear (thereby reducing metal contamination) and lubricant oxidation (thereby reducing oil thickening) will minimise oil degradation which is a major factor in sludge formation. The identification of effective antiwear and antioxidant additives are therefore important for the development of high performance engine oils.

One well known compound which provides both antiwear and antioxidant properties is zinc dialkyldithiophosphate ("ZDDP"). Generally ZDDP is employed at treat levels of 1 to 2 wt. % based on the total weight of the lubricating oil, which gives a phosphorus level in the lubricant typically in the range of from 0.05 to 0.15 wt. %, and a zinc level from 0.1 to 0.2 wt. %. In recent years there has been increasing concern that lubricant ash levels, such as that produced by the zinc in ZDDP. contribute to particulate emissions in the exhaust fumes from internal combustion engines. There is also concern that the phosphorus from the lubricant tends to poison catalysts used in catalytic converters, thereby preventing them from functioning to full effect.

Applicant's co-pending GB applications 93188951.1 and 9318923.1 both filed on the same day as the present application and both entitled "Lubricant Composition containing Antiwear Additive Combination" describe antiwear agents with reduced phosphorus and reduced or eliminated zinc content.

We have found that improved antioxidant performance can be obtained by combining the antiwear additive combinations disclosed in these patent applications with certain antioxidant combinations.

Accordingly the present invention provides a lubricant composition comprising a base oil and a combination of additives comprising:

(a) an organo-molybdenum compound, (b) an ashless organo-phosphorus compound, (c) a zinc thiophosphate compound selected from zinc dialkyl dithiophosphate, zinc diaryldithiophosphate, zinc alkylaryldithiophosphate, zinc arylalkyldithiophosphate and mixtures thereof, (d) an aminic antioxidant, and (e) a phenolic antioxidant, wherein the weight ratio of aminic antioxidant to phenolic antioxidant is greater than 1:1.

The present invention has the advantage that it provides a lubricant composition with good antiwear properties, whilst achieving low ash and phosphorus levels, and combines this antiwear system with enhanced oxidation performance by using the antioxidant additive combination as defined above, provided the amine and phenolic components of the antioxidant combination are used with a specific range of ratios relative to each other.

The organo group of the organo-molybdenum compound is preferably selected from a carbamate, a carboxylate and a xanthate group and mixtures thereof, which groups may be substituted with a hydrocarbyl group and/or one or more hetero atoms, with the proviso that the organo group selected results in an organo-molybdenum compound that is oil-soluble or oil-dispersible, preferably oil-soluble. It is preferred that the organo-molybdenum compound is phosphorus-free.

Where the organo group is a carbamate, which is preferred, the organo-molybdenum compound is preferably a molybdenum dicarbamate, more preferably a molybdenum dithiocarbamate of the formula:

(I)

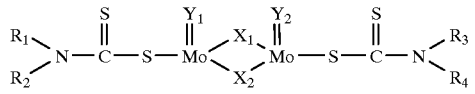

where $R_1$, $R_2$, $R_3$ and $R_4$ each independently represent a hydrogen atom, a $C_1$ to $C_{20}$ alkyl group, a $C_6$ to $C_{20}$ cycloalkyl, aryl, alkylaryl or aralkyl group, or a $C_3$ to $C_{20}$ hydrocarbyl group containing an ester, ether, alcohol or carboxyl group; and $X_1$ $X_2$, $Y_1$ and $Y_2$ each independently represent a sulphur or oxygen atom.

Examples of suitable groups for each of $R_1$, $R_2$, $R_3$ and $R_4$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. Preferably $R_1$ to $R_4$ are each $C_6$ to $C_{18}$ alkyl groups, more preferably $C_{10}$ to $C_{14}$.

It is preferred that $X_1$ and $X_2$ are the same, and $Y_1$ and $Y_2$ are the same. Most preferably $X_1$ and $X_2$ are both sulphur atoms. and $Y_1$ and $Y_2$ are both oxygen atoms.

Thus in a preferred embodiment the organo-molybdenum compound is sulphurised oxymolybdenum dithiocarbamate wherein the thiocarbamate groups contain $C_{10}$ to $C_{14}$ alkyl groups. Such compounds are commercially available and are supplied, for example, by R.T. Vanderbilt Company.

Where the organo group of the organo-molybdenum compound is a carboxylate, this is preferably a $C_1$ to $C_{50}$, more preferably a $C_6$ to $C_{18}$, carboxylate group. Examples of suitable carboxylates include octoate, e.g. 2-ethyl hexanoate, naphthenate and stearate. These compounds may be prepared, for example, by reacting molybdenum trioxide with the alkali metal salt of the appropriate carboxylic acid under suitable conditions.

Where the organo group of the organo-molybdenum compound is a xanthate, the compound preferably has the formula:

$$Mo_2(ROCS_2)_4 \quad \text{(II)}$$

where R is a $C_1$ to $C_{30}$ hydrocarbyl group, preferably an alkyl group. Examples of suitable molybdenum xanthate compounds and their method of preparation are described in European patent application EP-A-433025, the disclosure of which is incorporated herein by reference.

The ashless organo-phosphorus compound is essentially free of metal, and preferably contains sulphur. Phosphorothiolothionates and phosphorothionates and mixtures thereof are preferred compounds Phosphorothiolothionates have the general formula:

(III)

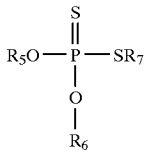

where $R_5$, $R_6$ and $R_7$ each independently represent a hydrocarbyl group which may be substituted with one or more functional groups or hetero atoms, or may be unsubstituted, and which may be branched or straight-chain.

Preferably $R_5$ and $R_6$ are each a $C_1$ to $C_{30}$ alkyl group, or a $C_6$ to $C_{30}$ cycloalkyl, aryl, aralkyl or alkylaryl group. $R_7$ is preferably a $C_1$ to $C_{30}$ alkyl group, a $C_6$ to $C_{30}$ cycloalkyl, aryl, aralkyl or alkylaryl group, or a $C_1$ to $C_{30}$ hydrocarbyl group containing one or more carboxylic acid, ester, alcohol, ether or amine groups, or an ammonium ion, preferably one or more carboxylic acid groups. Examples of suitable phosphorothiolothionates which are commercially available include VANLUBE 727, VANLUBE 7611 both supplied by R.T. Vanderbilt Company, IRGALUBE 63 supplied by Ciba-Geigy, and ECA 6330 supplied by Exxon Chemical Company.

Phosphorothionates have the general formula:

(IV)

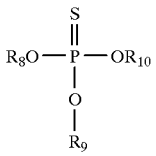

where $R_8$, $R_9$, and $R_{10}$ each represent a hydrocarbyl group which may be substituted with one or more functional groups or hetero atoms, or may be unsubstituted, and which may be branched or straight-chain.

Preferably $R_8$ and $R_9$ are each a $C_1$ to $C_{30}$ alkyl group or a $C_6$ to $C_{30}$ cycloalkyl, aryl aralkyl or alkylaryl group. $R_{10}$ is preferably a $C_1$ to $C_{30}$ alkyl group or a $C_6$ to $C_{30}$ cycloalkyl, aryl, aralkyl or alkylaryl group, or a $C_1$ to $C_{30}$ hydrocarbyl group containing one or more amine, carboxylic acid, ester, alcohol or ether groups, or an ammonium ion, preferably an amine group or ammonium ion. Examples of suitable phosphorothionates which are commercially available include IRGALUBE TPPT supplied by Ciba-Geigy.

The zinc thiophosphate compound (c) has the general formula:

(V)

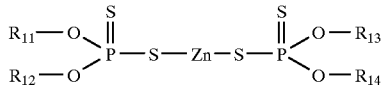

where $R_{11}$, $R_{12}$, $R_{13}$ and $R_{14}$ each independently represent a hydrogen atom, a $C_1$ to $C_{20}$ alkyl group, a $C_6$ to $C_{26}$ cycloalkyl, aryl, alkylaryl or aralkyl group, or a $C_3$ to $C_{20}$ hydrocarbyl group containing an ester, ether, alcohol or-carboxyl group. Preferably each of $R_{11}$ to $R_{14}$ is a $C_2$ to $C_{18}$, more preferably $C_3$ to $C_8$, alkyl group which may be straight-chain or branched. Such compounds are commercially available and are supplied by, for example, Exxon Chemical Company.

The amounts of each of the antiwear additives (a), (b) and (c) to be included in the lubricant composition according to the invention are the amounts that are effective in providing the desired level of antiwear performance, whilst reducing the amount of phosphorus and zinc to an acceptable level.

Whilst not being limited to any particular theory, it is believed that the antiwear properties of the organo-molybdenum compound (a) are generally attributable to the presence of the molybdenum. Thus when determining the amount of organo-molybdenum compound to be incorporated into the lubricant composition, one first needs to determine the desired amount of molybdenum. Preferably the amount of molybdenum contained in the lubricant composition is from 0.001 to 0.5 wt. %, more preferably 0.005 to 0.2 wt. %, and most preferably 0.01 to 0.05 wt. %, based on the total weight of the lubricant composition. The amount of organo-molybdenum compound that this corresponds to depends upon the type of compound selected.

Where the organo-molybdenum compound is a dithiocarbamate, the amount of compound used depends on the molecular weight of the R groups contained in the thiocarbamate groups, as defined in formula (I) above. Typically, however, the amount of molybdenum dithiocarbamate used is preferably from 0.01 to 3.0 wt. %, more preferably from 0.02 to 2.0 wt. %, and most preferably from 0.05 to 1.0 wt. %, based on the total weight of the lubricant composition.

Where the organo-molybdenum compound is a carboxylate, the amount of compound used depends upon the molecular weight of the carboxylate group selected. For example, where the carboxylate is 2-ethyl hexanoate, the amount of molybdenum carboxylate used is preferably from 0.005 to 2.5 wt. %, more preferably from 0.025 to 1.0 wt. %, and most preferably from 0.05 to 0.25 wt. %, based on the total weight of the lubricant composition.

Where the organo-molybdenum compound is a xanthate, the amount of compound used depends upon the molecular weight of the hydrocarbyl, e.g. alkyl, groups contained in the xanthate groups. Typically, however, the amount of molybdenum xanthate used is preferably from 0.003 to 2.0 wt. %, more preferably from 0.01 to 0.7 wt. % and most preferably from 0.03 to 0.2 wt. %, based on the total weight of the lubricant composition.

Similarly, it is believed that the antiwear properties of the ashless organo-phosphorus and zinc thiophosphate compounds are generally attributable to the presence of the phosphorus. Thus when determining amounts of these compounds to incorporate, one first needs to determine the desired amount of phosphorus in the lubricant composition. Preferably the total amount of phosphorus contained in the lubricant composition is from 0.001 to 0.3 wt. %, more preferably from 0.01 to 0.2 wt. %, and most preferably from 0.02 to 0.1 wt. %, based on the total weight of the lubricant composition. The amounts of ashless organo-phosphorus compound and zinc thiophosphate compound that this corresponds to depends upon the relative proportions of these compounds and the molecular weight of the specific compounds selected. Typically, however, the amount of ashless organo-phosphorus compound incorporated into the lubricant composition is from 0.01 to 0.3 wt. %, more preferably 0.05 to 2.0 wt. %, and most preferably 0.1 to 1.0 wt. % based on the total weight of the lubricant composition, and the amount of zinc thiophosphate compound is preferably from 0.01 to 3.0 wt. %, more preferably 0.1 to 2.0 wt. %, and most preferably 0.2 to 1.0 wt. % based on the total weight of the lubricant composition.

The ratio of compounds (a):(b):(c) in the lubricant composition is preferably such that the weight ratio of molybdenum to phosphorus is from 1:50 to 100:1, more preferably 10:1 to 20:1, and most preferably from 1:1 to 10:1. The weight ratio of phosphorus derived from the ashless organo-phosphorus compound (b) to zinc thiophosphate compound (c) is preferably from 10:1 to 1:20, more preferably from 5:1 to 1:15 and most preferably 1:1 to 1:10.

The aminic antioxidant is preferably an aromatic amine, more preferably a secondary aromatic amine. Such amines are well know and there is no particular restriction of the type of amine antioxidant employed, provided it is oil-soluble or oil-dispersible. Preferably the aminic antioxidant is secondary amine having the general formula

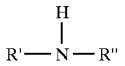

where R' and R" each independently represent a $C_1$ to $C_{20}$ substituted or unsubstituted alkyl group or a $C_6$ to $C_{30}$ substituted or unsubstituted cycloalkyl, aryl, aralkyl or alkylaryl group. If substituted, the substituent may be for example an alkyl, aryl, alkoxy, aryloxy, acyl, acylamino, hydroxy, carboxyl or nitro group. Preferably R' and R" are each a substituted or unsubstituted aryl or alkylaryl group.

Examples of suitable aminic antioxidants include diphenylamine, alkyldiphenylamines having one or more alkyl substituents each having up to about 16 carbon atoms, phenyl-α-naphthylamine, phenyl-β-naphthylamine, alkyl-substituted phenyl-α-naphthylamine or phenylβ-naphthylamine having one or more alkyl substituents each containing up to about 16 carbon atoms. Examples of suitable alkyl substituents include t-butyl, t-pentyl, hexyl, n-octyl, t-octyl, nonyl, decyl and dodecyl. Many secondary aromatic amine antioxidants are commercially available including, for example Irganox L57, Irganox L74 and Irganox L06 available from Ciba-Geigy, Vanlube 81, Vanlube SL, Vanlube 848 and Vanlube DND available from R.T. Vanderbilt; ADDITIN M10277 available from Rhein-Chemie; Lubrizol 5150A available from Lubrizol; Naugalube 438L and Naugalube 680 available from Uniroyal.

The phenolic antioxidant is preferably a hindered phenol. Such phenolic compounds are well-known and there is no particular restriction in the type of phenolic antioxidant employed provided it is oil-soluble or oil-dispersible. Preferably the phenolic antioxidant is a hindered phenol having the following formula:

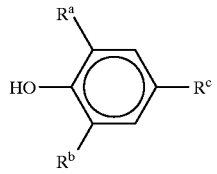

where $R^a$ and $R^b$ each independently represent a hydrogen atom or a $C_1$ to $C_{24}$ alkyl group, provided that at least one of $R^a$ and $R^b$ is an alkyl group; and $R^c$ is a hydrogen atom or a group having the formula:

$$—(CH_2)_n—X$$

where X is an alkyl, aryl, aralkyl, alkylaryl or cycloalkyl group, which may be substituted with one or functional groups and/or hetero atoms, and n is an integer from 1 to 24.

More preferably $R^a$ and $R^b$ are each selected from hydrogen, methyl, ethyl, propyl, isopropyl, n-butyl, t-butyl, pentyl, n-octyl, t-octyl, nonyl, decyl and dodecyl groups, provided $R^a$ and $R^b$ are not both hydrogen.

More preferably $R^c$ is selected from the group $—(CH_2)_mCOOR^d$ or $—(CH_2)_mSCOOR^d$ where $R^d$ is $C_1$ to $C_{18}$ alkyl or aryl group, and m is an integer from 1 to 18.

Alternatively the phenolic antioxidant may have the formula:

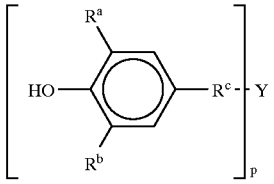

where Y is a carbon atom or a hetero atom, for example a sulphur atom, $R^a$, $R^b$ and $R_c$ are as defined above, and p is an integer from 2 to 4, the actual value of p depending upon the valency of Y.

Specific examples of suitable phenolic antioxidants include 2,6-di-t-butylphenol, 2,4,6-tri-t-butylphenol, 2-t-butylphenol, 4-methyl-2,6-di-t-butylphenol, 2-methyl-6-t-butylphenol, 2,4-dimethyl-6-t-butylphenol, and esters and sulphurised ester thereof, wherein the ester group is substituted in the para position on the phenol ring. Many phenolic antioxidants are commercially available and examples include L101, the Irganox products L101, L108, L118, L130, L135, L107, L109 and L115 available from Ciba-Geigy; Hitec 4701 available from Ethyl Corporation; Parabar 441 available from Exxon Chemical Company; and Vanlube 691C available from R.T. Vanderbilt Company.

The weight ratio of the two types of antioxidants should be such that the lubricant composition according to the invention contains more amine antioxidant by weight than phenolic antioxidant. Preferably the weight ratio of aminic to phenolic antioxidant is from 1.5:1 to 20:1, more preferably from 2:1 to 10:1, and most preferably from 3:1 to 5:1. The inclusion of at least a proportion of phenolic antioxidant in addition to aminic is preferred to ensure appropriate oxidative stability over a range of temperatures and conditions. It has also been suggested that the two components may act synergistically, at least under certain conditions, to give a higher activity for a given treat rate than either alone. Whilst not being limited to any particular theory it is believed that the two components may co-operate in interfering in free-radical oxidation mechanisms.

The amount of antioxidant compounds incorporated into the lubricant composition should be the amount which provides effective antioxidant protection. Preferably the total amount of phenolic and aminic antioxidant incorporated is from 0.1 to 5.0 wt. %, more preferably from 0.5 to 3.0 wt. %, and most preferably from 0.8 to 1.5 wt. %, based on the total weight of the lubricant composition.

Thus the amount of aminic antioxidant incorporated is preferably from greater than 0.05 to 4.8 wt. %, more preferably from 0.3 to 2.7 wt. %, and most preferably from 0.6 to 1.2 wt. %; and the amount of phenolic antioxidant incorporated is preferably from 0.01 to 2.5 wt. %, more preferably from 0.05 to 1.0 wt. %, and most preferably from 0.1 to 0.5 wt. %, based on the total weight of the lubricant composition.

The base oil employed in the lubricant composition according to the invention may be any base oil suitable for the intended use of the lubricant. Thus the base oil may be, for example, a conventionally refined mineral oil, an oil derived from coal tar or shale, a vegetable oil, an animal oil, a hydrocracked oil, or a synthetic oil, or a mixture of two or more of these types of oils. Examples of synthetic oils include hydroisomerised paraffins, polyalphaolefms, polybutene, alkylbenzenes, polyglycols, esters such as polyol esters or dibasic carboxylic acid esters, alkylene oxide polymers, and silicone oils. The viscosity of the base oil depends upon the intended use, but generally is in the range of from 3 to 20 cSt at 100° C.

The antiwear additive compounds (a), (b) and (c) and antioxidant compounds (d) and (e) may be mixed directly with the base oil, but, for ease of handling and introduction of the compounds to the base oil, are preferably in the form of additive concentrate comprising the additive compound, or mixture of any two or more of these compounds, contained in a carrier fluid. Thus in a further aspect the present invention provides an additive concentrate comprising compounds (a), (b), (c), (d) and (e) as defined above, and (f) a carrier fluid. The carrier fluid is typically an oil and may be, for example, any of the oils mentioned above in the description of the base oil. Alternatively, it may be an organic solvent, for example naphtha, benzene, toluene, xylene and the like. The carrier fluid should be compatible with the base oil of the lubricant composition, but otherwise is preferably inert. Generally the concentrate will comprise from 10 to 90 wt. % of the additive compound(s), preferably from 30 to 70 wt. %, the balance being the carrier fluid.

The lubricant composition according to the invention may also contain other additives, which may be added directly to the base oil, as a separate additive concentrate, or included in the concentrate of the antiwear and antioxidant additives. For example, where the lubricant is an engine oil, other additives that may be incorporated include one or more of a detergent, dispersant, corrosion inhibitor, extreme pressure agent, antifoaming agent, pour point depressant and viscosity index improver. Such additives are well-known and the selection of appropriate additives could readily be determined by a person skilled in the art of lubricant formulating.

The lubricant composition may find use in any application where the parts to be lubricated are subject to wear. It is especially suitable for use as an engine oil for internal combustion engines.

The invention is illustrated by the following Example.

EXAMPLE 1A

An engine oil was formulated by adding the following antiwear and antioxidant additives to a basecase oil having a viscosity of 14 cSt at 100° C. and consisting of a conventional engine oil based on a conventionally refined mineral oil and containing standard engine oil additives other than ZDDP:

(a) 0.2 wt. % MOLYVAN 822 (=0.01 wt. % Mo), a molybdenum dithiocarbamate supplied by R.T. Vanderbilt Company;

(b) 0.8 wt. % ECA 6330 (=0.025 wt. % P), a phosphorothiolothionate supplied by Exxon Chemical Company;

(c) 1.0 wt. % PARANOX 14 (=0.075 wt. % P), a ZDDP supplied by Exxon Chemical Company;

(d) 0.8 wt. % IRGANOX L57, a dialkyl-substituted diphenylamine supplied by Ciba-Geigy, and (e) 0.2 wt. % IRGANOX L118, an ester derivative of a 2,6-di-t-butylphenol supplied by Ciba-Geigy.

EXAMPLE 1B and 1C

Two further engine oils were formulated except that the amounts of aminic antioxidant (d) and phenolic antioxidant (e) were varied as follows:

Example 1B: 0.5 wt. % (d) IRGANOX L57, and 0.5 wt. % (e) IRGANOX L118

Example 1C: 0.2 wt. % (d) IRGANOX L57, and 0.8 wt. % (e) IRGANOX L118

All percentages are by weight based on the total weight of the fully formulated engine oil.

The resulting, fully formulated engine oils were tested for oxidation as follows:

The kinematic viscosity at 40° C. ($KV_{40}$) was measured using a Haake PK100 viscometer. 250 $cm^3$ of the oil was then placed in a glass tube with 40 ppm iron (using an oil-soluble iron catalyst), heated to 165° C., and maintained at that temperature for 168 hours in the presence of air flowing at a rate of 1.7 litres per minute. The $KV_{40}$ of the oil was then measured again, and thus the viscosity increase of the oil determined. The lower the viscosity increase, the better the antioxidation performance of the oil. The results are given in Table 1 below.

For comparative purposes, a further set of engine oils were formulated using the three formulations described above for Examples 1A, 1B and 1C, except that the antiwear additives (a), (b) and (c) were replaced by 1.2 wt. % PARANOX 14 ZDDP (=0.1 wt. % P). These engine oils were tested for oxidation as described above and the results are also given in Table 1.

TABLE 1

| | % Viscosity Increase Phenolic: Aminic Antioxidant Wt Ratio | | |
|---|---|---|---|
| Oil | 4:1 | 1:1 | 1:4 |
| Basecase + Triple Antiwear | >400 | 259 | 153 |
| Basecase + ZDDP | 195 | 189 | 193 |

The results show that altering the aminic antioxidant to phenolic antioxidant has significant effects on the oxidation performance of the oil when the triple antiwear additive combination is used, whereas altering the ratio has little, if any, effect when the sole antiwear additive is ZDDP. When the aminic to phenolic ratio is 4:1 good antioxidation performance is achieved with the lubricant containing the triple antiwear additive combination, but this performance is not achieved when the weight ratio of aminic to phenolic compounds is 1:1 or less than 1:1.

I claim:

1. A lubricant composition comprising a base oil and a combination of additives comprising:

(a) an organo-molybdenum compound, (b) an ashless organo-phosphorus compound, (c) a zinc thiophosphate compound selected from zinc dialkyl dithiophosphate, zinc diaryldithiophosphate, zinc alkylaryldithiophosphate, zinc arylalkyldithiophosphate or mixtures thereof, (d) an aminic antioxidant, and (e) a phenolic antioxidant, wherein the amount of organo-molybdenum compound (a) is such that the amount of molybdenum contained in the lubricant composition is from 0.001 to 0.5 wt %; the amounts of ashless organo-phosphorus compound (b) and zinc thiophosphate compound (c) are such that the amount of phosphorus contained in the lubricant composition is from 0.001 to 0.3 wt % and the weight ratio of phosphorus derived from the ashless organo-phosphorus compound to phosphorus derived from the zinc thiophosphate compound is from 10:1 to 1:20; and the combined amount of aminic antioxidant (d) and phenolic antioxidant (e) is from 0.1 to 5.0 wt % and the weight ratio of aminic antioxidant (d) to phenolic antioxidant (e) is greater than 1:1, the weight percents being based on the total weight of the lubricant composition.

2. The lubricant composition according to claim 1 wherein the weight ratio of aminic antioxidant to phenolic antioxidant is from 1.5:1 to 20:1.

3. The lubricant composition according to claim 1 wherein the weight ratio of aminic antioxidant to phenolic antioxidant is from 3:1 to 5:1.

4. The lubricant composition according to claims 1, 2 or 3 wherein the organo-molybdenum compound is a molybdenum dithiocarbamate.

5. The lubricant composition according to claims 1, 2 or 3 wherein the ashless organo-phosphorus compound is a phosphorothiolothionate or a phosphorothionate or a mixture thereof.

6. The lubricant composition to claim 1, 2 or 3 wherein the amount of organo-molybdenum compound contained in the lubricant composition is such that the amount of molybdenum contained in the lubricant composition is from 0.005 to 0.2 wt %, based on the total weight of the lubricant composition.

7. The lubricant composition according to claim 1, 2 or 3 wherein the amount of zinc thiophosphate compound and ashless organo-phosphorus compound contained in the lubricant composition is such that the amount of phosphorus contained in the lubricant composition is from 0.01 to 0.2 wt %, based on the total weight of the lubricant composition.

8. The lubricant composition according to claim 1, 2 or 3 wherein the weight ratio of phosphorus derived from the ashless organo-phosphorus compound to phosphorus derived from the zinc thiophosphate compound is from to 5:1 to 1:15.

9. The lubricant composition according to 1, 2 or 3 wherein the amount of aminic antioxidant contained in the lubricant composition is a form greater than 0.05 wt. % an up to 4.8 wt. % based on the total weight of the lubricant composition, and/or wherein the amount of phenolic antioxidant contained in the lubricant composition is from 0.01 to 2.5 wt. % based on the total weight of the lubricant composition.

10. An additive concentrate comprising:

(a) an organo-molybdenum compound, (b) an ashless organo-phosphorus compound, (c) a zinc thiophosphate compound selected from zinc dialkyl dithiophosphate, zinc diaryldithiophosphate, zinc alkylaryldithiophosphate, zinc arylalkyldithiophosphate or mixtures thereof, (d) an aminic antioxidant, (e) a phenolic antioxidant, and (f) a carrier fluid, wherein the amount of organo-molybdenum compound (a) is such that the amount of molybdenum contained in the lubricant composition to which the concentrate is added is from 0.001 to 0.5 wt %; the amounts of ashless organo-phosphorus compound (b) and zinc thiophosphate compound (c) are such that the amount of phosphorus contained in the lubricant composition to which the concentrate is added is from 0.001 to 0.3 wt % and the weight ratio of phosphorus derived from the ashless organo-phosphorus compound to phosphorus derived from the zinc thiophosphate compound is from 10:1 to 1:20; and the combined amount of aminic antioxidant (d) and phenolic antioxidant (e) contained in the lubricant composition to which the concentrate is added is from 0.1 to 5.0 wt % and wherein the weight ratio of aminic antioxidant to phenolic antioxidant is greater than 1:1 and the amount of carrier fluid (f) being from 10 to 90 wt %, the weight percent of said carrier being based on the total weight of the concentrate.

* * * * *